US009920463B2

(12) United States Patent
Kobayashi et al.

(10) Patent No.: US 9,920,463 B2
(45) Date of Patent: Mar. 20, 2018

(54) FIBER SHEET FOR MOLDING

(71) Applicant: JAPAN VILENE COMPANY, LTD., Tokyo (JP)

(72) Inventors: Masaki Kobayashi, Shiga (JP); Takashi Tokiwa, Shiga (JP)

(73) Assignee: JAPAN VILENE COMPANY, LTD., Tokyo (JP)

( * ) Notice: Subject to any disclaimer, the term of this patent is extended or adjusted under 35 U.S.C. 154(b) by 0 days.

(21) Appl. No.: 15/146,308

(22) Filed: May 4, 2016

(65) Prior Publication Data

US 2016/0332359 A1 Nov. 17, 2016

(30) Foreign Application Priority Data

May 14, 2015 (JP) ..... 2015-099424
Sep. 9, 2015 (JP) ..... 2015-177936

(51) Int. Cl.
*D04H 1/66* (2012.01)
*D04H 1/62* (2006.01)

(52) U.S. Cl.
CPC ..... *D04H 1/66* (2013.01); *D04H 1/62* (2013.01)

(58) Field of Classification Search
CPC ..... D04H 1/62; D04H 1/66
See application file for complete search history.

(56) References Cited

U.S. PATENT DOCUMENTS

2012/0184166 A1* 7/2012 Kurihara ..... D01F 6/625 442/181
2013/0112499 A1* 5/2013 Kitchen ..... B32B 5/26 181/296
2014/0120322 A1* 5/2014 Fu ..... D04H 1/4242 428/176

FOREIGN PATENT DOCUMENTS

JP 2012-102437 A 5/2012
JP 2014-214390 A 11/2014

* cited by examiner

*Primary Examiner* — Laura C Powers
(74) *Attorney, Agent, or Firm* — Heslin Rothenberg Farley & Mesiti P.C.

(57) ABSTRACT

Provided is a fiber sheet for molding, characterized in that a print resin is applied on the surface of the fiber sheet containing highly crimped fibers, and the amount of the print resin is 30 g/m$^2$ or less, and the air permeability of the fiber sheet is 5 to 30 cm$^3$/cm$^2$/sec. The fiber sheet for molding can be molded without generating wrinkles, and has a good sound absorbing property. When a pattern is formed with the printing resin, the fiber sheet for molding is also excellent in design properties.

2 Claims, 1 Drawing Sheet

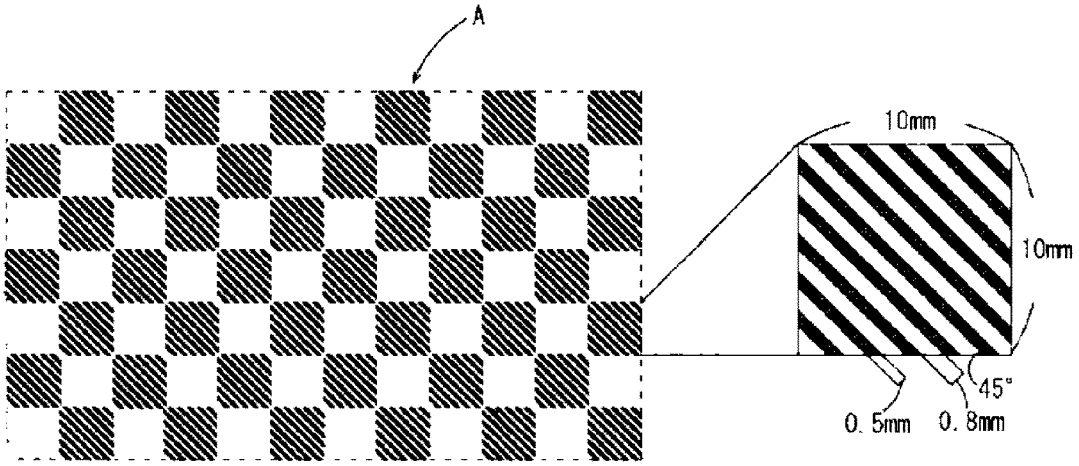
A
10mm
10mm
45°
0. 5mm
0. 8mm

FIBER SHEET FOR MOLDING

CROSS REFERENCE TO RELATED APPLICATIONS

This application is a U.S. national application claiming priority to Japanese Patent Application No. 2015-099424, filed May 14, 2015, and to Japanese Patent Application No. 2015-177936, filed Sep. 9, 2015. The entire contents of each of the prior applications are hereby incorporated herein by reference.

TECHNICAL FIELD

The present invention relates to a fiber sheet for molding, in particular, a fiber sheet for molding, in which it is stretchy during molding, wrinkles are not generated, and it is excellent in sound absorbing properties, and a fiber sheet for molding, which is excellent in design. The fiber sheet for molding of the present invention can be suitably used as a fiber sheet for molding of, particularly, automotive applications.

BACKGROUND ART

Conventionally, fiber sheets are generally molded in order to fit them to certain shapes for various applications. As such molding methods, a heat press method, in which a pair of molds are used to mold a fiber sheet by the action of heat and pressure, or a cold press method, in which a pair of molds are used to mold a pre-heated fiber sheet by the action of pressure, are known.

In the case of molding by the former, i.e., the heat press method, the present applicant proposed "a fiber sheet for molding, characterized by being made of a fiber base material containing latent crimpable fibers of which crimps are expressed" (Patent literature 1) in order to improve the followability of the fiber sheet to the shape of the molds. However, since this fiber sheet for molding is poor in sound absorbing properties, in order to obtain sound absorbing properties, it is necessary to laminate it with a base material mat having good sound absorbing properties, or to use an adhesive resin film as an adhesive layer for adhering it to the base material mat. However, in the case of the former, i.e., laminating it with the base material mat having good sound absorbing properties, there is a problem in that the base material mat is limited, and that it is poor in versatility. In the case of the latter, i.e., using the adhesive resin film, regardless of the fact that it contains latent crimpable fibers of which crimps are expressed in order to improve the followability to the shape of the molds, there is a problem in that, since the adhesive resin film is difficult to stretch, a large amount of force is needed during molding, and if the molding is completed, there is another problem in that, since the adhesive resin film has low air permeability and it is difficult for the air to escape during molding, wrinkles are likely to occur.

Further, the present applicant proposed "a surface material for molding, characterized by consisting of a nonwoven fabric containing latent crimpable fibers of which crimps are expressed, wherein air permeability is 5 to 20 ($cm^3/cm^2 \cdot s$), and an extension at a load of 10 N in at least one direction is 50 mm or more" (Patent literature 2). Such a surface material for molding is actually produced by heating and pressing a crimp-expressing fiber web containing latent crimpable fibers, of which crimps are expressed. However, in order to achieve such a low air permeability, it is necessary to relatively strongly heat and press the web, and therefore, there is a problem in that the bulk of the surface material for molding is crushed to become paper-like, and that wrinkles are likely to occur when deep-drawing is carried out.

CITATION LIST

Patent Literature

[Patent literature 1] JP 2012-102437 A
[Patent literature 2] JP 2014-214390 A

SUMMARY OF INVENTION

Technical Problem

The present invention has been completed under these circumstances, and an object of the present invention is to provide a fiber sheet for molding that can be molded without generating wrinkles, and has good sound absorbing properties. Another object is to provide a fiber sheet for molding that is excellent in design.

Solution to Problem

The invention set forth in claim 1 of the present invention is "a fiber sheet for molding, characterized in that a print resin is applied on the surface of the fiber sheet containing highly crimped fibers, and the amount of the print resin is 30 $g/m^2$ or less, and the air permeability of the fiber sheet is 5 to 30 $cm^3/cm^2/sec$.

The invention set forth in claim 2 of the present invention is "the fiber sheet for molding according to claim 1, characterized in that a pattern is formed with the print resin".

Advantageous Effects of Invention

The invention set forth in claim 1 of the present invention is a fiber sheet for molding that can be easily molded without generating wrinkles, because it is made of a fiber sheet containing highly crimped fibers, and the content of the print resin is small, and therefore, it does not inhibit the extension of the highly crimped fibers, and it can extend with a small bit of force. Further, since it has a certain air permeability of 5 $cm^3/cm^2/sec$ or more, the air easily escapes during molding, and therefore, it is a fiber sheet for molding in which wrinkles are unlikely to occur. Furthermore, since the air permeability is relatively low (30 $cm^3/cm^2/sec$ or less), and it is easy to convert sound energy into thermal energy, it has good sound absorbing properties. Furthermore, since the fiber sheet for molding per se has good sound absorbing properties, it is not necessary to laminate it with materials having good sound absorbing properties, and it can be combined with various materials, and therefore, it has good versatility.

The invention set forth in claim 2 of the present invention is excellent in design, because the pattern is formed with a print resin.

BRIEF DESCRIPTION OF THE DRAWINGS

FIG. 1 A plane view which shows the arrangement of print resin liquid A in Example 6.

DESCRIPTION OF EMBODIMENTS

The fiber sheet for molding of the present invention is based on a fiber sheet containing highly crimped fibers.

Since the highly crimped fibers have literally many crimps, and are stretchy because of the pressure at the time of molding, it can be molded with a small force, and therefore, is a fiber sheet for molding that hardly generates wrinkles during molding. The number of crimps is preferably 50 crimps/inch or more, so that the highly crimped fibers can be easily stretched. The number of crimps means a value obtained by a method defined in JIS L1015:2010, 8.12.1 (Number of crimps).

The highly crimped fibers, which may be used in the present invention, can be obtained by expressing crimps in latent crimpable fibers. Since the highly crimped fibers obtained by expressing crimps in latent crimpable fibers have a three-dimensional spiral form, they are stretchy because of the pressure at the time of molding.

As the latent crimpable fibers, which may be based on the highly crimped fibers, for example, composite fibers in which multiple resins different in heat shrinkage percentage are combined, or fibers which have been partially subjected to a specific thermal hysteresis, can be used. More particularly, as the composite fibers, composite fibers having a fiber cross-section of an eccentric type having a core-sheath structure, or composite fibers which are a side-by-side type, can be preferably used. Examples of the combination of resins different in heat shrinkage percentage include various combinations of polyester/low melting point polyester, polyamide/low melting point polyamide, polyester/polyamide, polyester/polypropylene, polypropylene/low melting point polypropylene, polypropylene/polyethylene, and the like. More particularly, latent crimpable fibers consisting of polyester/low melting point polyester or polypropylene/low melting point polypropylene are preferred, because the three-dimensional spiral shape can be easily formed, and they are stretchy.

Examples of the latent crimpable fibers which have been partially subjected to a specific thermal hysteresis include fibers obtained by passing fibers made of a thermoplastic resin, such as polyester or polyamide, while one side of the fibers is brought into contact with a heated blade or the like.

The fineness of the latent crimpable fibers is not particularly limited, but it is preferably 4.4 dtex or less, and more preferably 3.3 dtex or less, so that it is excellent in sound absorbing properties and appearance quality after molding. The lower limit of the fineness is not particularly limited, but it is preferably 0.5 dtex or more, and more preferably 0.8 dtex or more, so that the fibers are stretchy and excellent in appearance quality. Two or more kinds of latent crimpable fibers different in fineness may be used as the latent crimpable fibers. In this case, it is preferable that the average fineness calculated by the following equation is within the above-mentioned fineness range. In the case where three or more kinds of latent crimpable fibers different in fineness are used, it is preferable that the average fineness calculated in a similar fashion is within the above-mentioned fineness range.

$$Fav=1/[(Pa/100)/Fa+(Pb/100)/Fb]$$

wherein Fav is the average fineness (unit: dtex), Pa is a mass percentage of one latent crimpable fiber (latent crimpable fiber A) contained in the fiber sheet (unit: mass %), Fa is a fineness of latent crimpable fiber A (unit: dtex), Pb is a mass percentage of another latent crimpable fiber (latent crimpable fiber B) contained in the fiber sheet (unit: mass %), and Fb is a fineness of latent crimpable fiber B (unit: dtex).

In connection with this, when the highly crimped fibers are obtained by expressing crimps in latent crimpable fibers, the fineness of the highly crimped fibers is slightly thicker than that of the latent crimpable fibers, because the resin(s) which constitutes the latent crimpable fibers is heat-shrinked.

The fiber length of the latent crimpable fibers is not particularly limited, but it is preferably 20 to 80 mm, and more preferably 30 to 70 mm, so that the fiber sheet for molding is stretchy, and excellent in appearance quality. In connection with this, when the highly crimped fibers are obtained by expressing crimps in latent crimpable fibers, the fiber length of the highly crimped fibers is slightly shorter than that of the latent crimpable fibers, because the resin(s) which constitutes the latent crimpable fibers is heat-shrinked.

The highly crimped fibers, which constitute the fiber sheet of the present invention, can be obtained by expressing crimps in the above-mentioned latent crimpable fibers, and the crimps can be expressed by heating. The heating may be carried out using, for example, a hot-air dryer, an infrared lamp, a heating roll, or the like. The heating is preferably carried out under conditions where pressure by a solid is not applied, for example, using a hot-air dryer, an infrared lamp, or the like, so that the expression of crimps of the latent crimpable fibers is not hindered. In the case where the crimps of the latent crimpable fibers are expressed after forming a fiber web containing the latent crimpable fibers, it is preferable that the crimps are expressed by heating while being overfed, in anticipation of shrinkage of the fiber web due to the expression of crimps of the latent crimpable fibers, so that a stretchy fiber sheet for molding can be obtained.

As the fiber sheet before printing is easy to stretch, the highly crimped fibers account for preferably 50 mass % or more, more preferably 70 mass % or more, still more preferably 80 mass % or more, still more preferably 90 mass % or more, and most preferably 100 mass %.

Fibers other than the highly crimped fibers, which constitute the fiber sheet, are not particularly limited. When it is applied to applications that require flame retardancy, for example, an automobile field, synthetic fibers having a melting point or a decomposition point of 200° C. or higher are preferred, so that they are excellent in flame retardancy. More particularly, examples of the synthetic fibers include polyester-based fibers (polyethylene terephthalate fibers, polybutylene terephthalate fibers, polytrimethylene terephthalate fibers, and the like), polyamide-based fibers (nylon 6 fibers, nylon 66 fibers, and the like), polyvinyl alcohol fibers, acrylic fibers, polyvinyl chloride fibers, polyurethane fibers, fluorine fibers, aramid fibers, and the like. The fineness of such synthetic fibers is preferably 4.4 dtex or less, and more preferably 3.3 dtex or less. The lower limit of the fineness of the synthetic fibers is not particularly limited, but it is preferably 0.5 dtex or more, and more preferably 0.8 dtex or more. The fiber length of the synthetic fibers is not particularly limited, but it is preferably 20 to 80 mm, and more preferably 30 to 70 mm.

As the fibers other than the highly crimped fibers, which constitute the fiber sheet, cellulose-based fibers can also be used. Since cellulose-based fibers are carbonized during combustion, and exhibit an effect of reducing a combustion speed, they are excellent in flame retardancy. Examples of such cellulose-based fibers include rayon fibers, polynosic fibers, cupra fibers, cotton fibers, hemp fibers, and the like. Among these cellulose-based fibers, cotton fibers or rayon fibers are preferable in terms of economic efficiency, and rayon fibers are most preferable. This is because rayon fibers are excellent in workability, such as in staining, and even when they are combusted, no toxic gases are generated, and the temperature does not rise to a high degree. The fineness of the cellulose-based fibers is preferably 4.4 dtex or less, and more preferably 3.3 dtex or less. The lower limit of the fineness of the cellulose-based fibers is not particularly limited, but it is preferably 0.5 dtex or more, and more preferably 0.8 dtex or more. The fiber length of the cellulose-based fibers is not particularly limited, but it is preferably 20 to 80 mm, and more preferably 30 to 70 mm.

The term "melting point" as used herein means a melting temperature read from a DSC curve obtained by a heat-flux differential scanning calorimetry (DSC) in accordance with the provisions of JIS K 7121-1987. The term "extrapolation melting starting temperature" as used herein means an extrapolation melting starting temperature read from a DSC curve obtained by a heat-flux differential scanning calorimetry (DSC) in accordance with the provisions of JIS K 7121-1987. The term "decomposition point" as used herein means starting temperature T1 defined in JIS K 7120-1987 (Testing methods of plastics by thermogravimetry). The "fineness" as used herein means a value obtained by Method A defined in JIS L 1015:2010, 8.5.1 (Fineness based on corrected weight). The term "fiber length" as used herein means a value obtained by JIS L 1015:2010, 8.4.1 [Corrected staple diagram method (Method B)].

The fiber sheet of the present invention contains the above-mentioned highly crimped fibers, and its form may be, for example, a nonwoven fabric, a woven fabric, or a knitted fabric. Among these fabrics, preferred is a nonwoven fabric, in which the highly crimped fibers can be randomly arranged, and which is excellent in moldability.

The fiber sheet containing the highly crimped fibers may be formed by a conventional method. The nonwoven fabric, which is a preferred embodiment, may be produced, for example, by forming a fiber web containing latent crimpable fibers, of which crimps are not expressed, by a dry-laid method, such as a carding method, an air-laid method, or the like, a wet-laid method, or a direct method, such as a spunbond method or the like, and subjecting the fiber web to a heat treatment, to thereby express the crimps of the latent crimpable fibers. In order to improve the form stability of the nonwoven fabric, it is preferable that the fiber web is entangled by applying needles or a fluid, such as a water jet, before the heat treatment. In particular, the entanglement using a water jet is preferred, because a stretchy nonwoven fabric can be produced. In connection with this, it is preferable that the fiber sheet of the present invention containing the highly crimped fibers is not bonded by a binder. This is because, due to the bonding of the fiber sheet with the binder, the stretch during molding becomes worse, and wrinkles are likely to occur.

Since such a fiber sheet has relatively high air permeability and a poor sound absorbing property, the fiber sheet for molding of the present invention has a print resin on the surface of the above-mentioned fiber sheet in order to improve the sound absorbing property. As described above, since the fiber sheet is stretchy, because it contains the highly crimped fibers, and since the stretch of the highly crimped fibers is not inhibited, because the amount of the print resin is low (30 g/m$^2$ or less), it can be stretched with a small force, and can be molded without generating wrinkles. Further, since it has an air permeability of 5 cm$^3$/cm$^2$/sec or more, and the air easily escapes during molding, wrinkles are unlikely to occur. Furthermore, since it has an air permeability of 30 cm$^3$/cm$^2$/sec or less, which is relatively low, it is excellent in sound absorbing property, because it is easy to convert sound energy into thermal energy.

Because, when the amount of the resin is small, it is difficult to inhibit the stretch of the highly crimped fibers, and it can be stretched with a small force, and it can be molded without generating wrinkles, the amount of the print resin is preferably 28 g/m$^2$ or less, more preferably 26 g/m$^2$ or less, still more preferably 24 g/m$^2$ or less, and most preferably 22 g/m$^2$ or less. On the other hand, since when the amount of the print resin is too small, it tends to be difficult to have an air permeability of 30 cm$^3$/cm$^2$/sec or less, it is preferably 5 g/m$^2$ or more, more preferably 10 g/m$^2$ or more, and still more preferably 15 g/m$^2$ or more.

The resin used in the fiber sheet of the present invention is not particularly limited, so long as the air permeability is 5 to 30 cm$^3$/cm$^2$/sec with an amount of print resin of 30 g/m$^2$ or less. Examples of the resin include an acrylic resin, a polyester resin, and/or a polyurethane resin.

The pattern of the print resin is not particularly limited, so long as the air permeability is 5 to 30 cm$^3$/cm$^2$/sec. The print resin can be applied wholly and/or partially. In particular, it is preferable that the print resin is applied wholly, because the air permeability is within the range.

It is preferable that the pattern is formed with the print resin, because it is excellent in design. The pattern with the print resin is not particularly limited, but examples include a lattice pattern, a checkered pattern, a vertical stripes pattern, a horizontal stripes pattern, a dot pattern, and a herringbone pattern.

The pattern with the print resin may be formed (1) by partially applying the print resin, (2) by partially applying, on the surface where one print resin (sometimes referred to as solid print resin) is wholly applied, another print resin (sometimes referred to as pattern print resin) different in brightness, color, and/or saturation from the solid print resin, or (3) by partially applying one print resin (pattern print resin), and applying another print resin different in brightness, color, and/or saturation from the pattern print resin on the remaining area. Among these patterns, it is preferable to wholly apply the print resin, such as (2) or (3), because the air permeability can be within the above-mentioned range, and it is excellent in design due to the pattern print resin. The pattern print resin may be one kind of resin, and may be two or more resins, which are different in brightness, color, and/or saturation.

In addition to the print resin, the fiber sheet can contain a functional substance. For example, the design of the fiber sheet for molding can be imparted or improved by containing a dye or a pigment. The flame retardancy of the fiber sheet for molding can be imparted or improved by containing a flame retardant, for example, a phosphorus-based flame retardant, a bromine-based flame retardant, or an inorganic flame retardant. The antifouling property of the fiber sheet for molding can be imparted or improved by containing a water repellent or an oil repellent. The hydrophilicity of the fiber sheet for molding can be imparted or improved by containing a detergent. Two or more functional substances may be contained.

The print resin used in the present invention can be formed by a conventional method. For example, the fiber sheet having the print resin wholly may be formed by a planographic printing. The fiber sheet having the print resin partially may be formed by a letterpress printing, an intaglio printing, a stencil printing, or the like.

Since the fiber sheet for molding of the present invention has an air permeability of 5 cm$^3$/cm$^2$/sec or more, regardless of a small amount of print resin, the air can easily escapes during molding, and wrinkles are unlikely to occur. Furthermore, since it has an air permeability of 30 cm$^3$/cm$^2$/sec or less, which is relatively low, it is excellent in sound absorbing property, because it is easy to convert sound energy into thermal energy. The air permeability is preferably 10 to 28 $cm^3/cm^2/sec$, and more preferably 15 to 25 $cm^3/cm^2/sec$. The air permeability is a value measured by 6.8.1 (a Frazier method) defined in JIS L1913:2010 "Test methods for nonwovens".

The mass per unit area and the thickness of the fiber sheet for molding of the present invention vary depending on its applications or the like, and therefore, are not particularly limited, but the mass per unit area is preferably 50 to 200 $g/m^2$, more preferably 80 to 180 $g/m^2$, and still more preferably 120 to 170 $g/m^2$. The thickness of the fiber sheet for molding is preferably 0.1 to 0.8 mm, more preferably 0.2 to 0.7 mm. The mass per unit area is a value measured by 6.2 [mass per unit area (ISO method)] defined in JIS L1913: 2010 "Test methods for nonwovens". The thickness is a value measured, using a compressive elasticity tester (Lightmatic (registered trademark) VL-50, manufactured by Mitutoyo Corporation), at a load of 2.00 kPa per a loading area of 5 $cm^2$.

In the fiber sheet for molding of the present invention, for example, a precursory fiber sheet containing the latent crimpable fibers is formed, and the fiber sheet containing the highly crimped fibers is formed by expressing the crimps of the latent crimpable fibers. Next, the fiber sheet is compressed in the thickness direction so that the air permeability of the fiber sheet becomes about 20 to 50 $cm^3/cm^2/sec$, and the print is applied on the surface of the compressed fiber sheet at an amount of 30 $g/m^2$ or less (solid content), and dried to produce the fiber sheet for molding of the present invention having an air permeability of 5 to 30 $cm^3/cm^2/sec$.

More particularly, in the case where the fiber sheet is made of a nonwoven fabric, which is a preferable embodiment, a fiber web containing latent crimpable fibers is formed by a dry-laid method, such as a carding method, an air-laid method, or the like, a wet-laid method, or a direct method, such as a spunbond method or the like, and the fiber web is subjected to a heat treatment, to thereby express the crimps of the latent crimpable fibers, and is converted to highly crimped fibers, and a nonwoven fabric containing the highly crimped fibers is formed. In order to improve the form stability of the nonwoven fabric, it is preferable that the fiber web is entangled by applying needles or a fluid, such as a water jet, before the heat treatment. In connection with this, it is preferable that the fiber sheet is not bonded by a binder. This is because, due to the bonding of the fiber sheet with the binder, the stretch during molding becomes worse, and wrinkles are likely to occur.

The heating is preferably carried out under conditions where pressure by a solid is not applied, for example, using a hot-air dryer, an infrared lamp, or the like, so that the expression of crimps of the latent crimpable fibers is not hindered. In order to obtain a stretchier nonwoven fabric, it is preferable that the crimps are expressed by heating while being overfed, in anticipation of shrinkage of the fiber web due to the expression of crimps of the latent crimpable fibers.

Next, it is preferable that the nonwoven fabric is compressed in the thickness direction so that the air permeability of the nonwoven fabric becomes about 20 to 50 $cm^3/cm^2/sec$ (preferably 25 to 40 $cm^3/cm^2/sec$. In the case where a pattern is formed using the print resin, it is preferable that the nonwoven fabric is compressed in the thickness direction, because the surface of the nonwoven fabric becomes smooth by the compression, and the pattern becomes clear and is excellent in design. The compression method is not particularly limited, but may be carried out using, for example, a calender, a flat press, or the like. If fibers, such as highly crimped fibers or the like, are fused by the compression step, the fiber sheet for molding in which the stretch during molding becomes worse and wrinkles are likely to occur is obtained, and therefore, it is preferable that the fibers, such as highly crimped fibers or the like, are compressed under conditions where they are not fused, so that the air permeability falls within the above-mentioned range. The compression conditions are not particularly limited, so long as the air permeability falls within the above-mentioned range. In the case where they are compressed using a calender, when the compression is carried out at a temperature lower than the extrapolation melting starting temperature (preferably a temperature 10° C. or more lower than the extrapolation melting starting temperature) of a resin component having the lowest extrapolation melting starting temperature, among resin components which constitute the nonwoven-fabric-constituent fibers, and at a linear pressure of 1 to 10 kg/cm (preferably 3 to 7 kg/cm), the air permeability falls within the above-mentioned range, and the surface of the nonwoven fabric becomes smooth.

The print resin is applied on the surface of the compressed nonwoven fabric at an amount of 30 $g/m^2$ or less (solid content), and dried to produce the fiber sheet for molding having an air permeability of 5 to 30 $cm^3/cm^2/sec$. It is preferable that the print resin is wholly applied on the surface of the compressed nonwoven fabric, because the air permeability is within the range. The print resin can be wholly applied by, for example, planographic printing. On the other hand, it is preferable that the print resin is partially applied to form a pattern, because it is excellent in design. The pattern formation by partially applying the print resin can be carried out by, for example, letterpress printing, intaglio printing, or stencil printing. With respect to the printing by wholly applying the print resin and the pattern formation by partially applying the print resin, both can be carried out, the pattern can be formed by repeating the partial application of the print resin, or the print resin can be wholly applied as a result of repeating the partial application of the print resin. The drying step can be carried out by, for example, hot-air drying, cold-air drying, drying under reduced pressure, far-infrared drying, or the like.

The fiber sheet for molding of the present invention is stretchy during molding, can be molded without generating wrinkles, and is excellent in sound absorbing properties, and therefore, it can be suitably used in applications that require such properties. For example, it can be suitably used as a fiber sheet for the molding of automotive applications. The molding can be carried out by heat press or cold press, and regardless of the type of press, a mold sheet, in which it is stretchy during molding, can be molded without generating wrinkles, and is excellent in sound absorbing properties, can be obtained. Since the fiber sheet for molding of the present invention per se is excellent in sound absorbing properties, if it is laminated with other materials, the materials are not necessary to be excellent in sound absorbing properties, and therefore, the fiber sheet can be used together with various materials, and is excellent in versatility.

The fiber sheet for molding of the present invention can be used alone, or can be used together with other materials in various applications. In order to easily combine it with other materials during molding, the fiber sheet for molding of the present invention can contain an adhesive layer. In order to easily adhere it to other materials, the adhesive layer preferably contains a resin (sometimes referred to as "adhesive resin") having a melting point of 200° C. or less, more preferably an adhesive resin having a melting point of 190° C. or less, and still more preferably an adhesive resin having a melting point of 180° C. or less. On the other hand, since the heat resistance is lowered and the applications are limited, when the melting point is too low, an adhesive resin having a melting point of 80° C. or more is preferable, and an adhesive resin having a melting point of 90° C. or more is more preferable.

As the adhesive resin, one resin or two or more resins selected from, for example, polypropylene, polyethylene (for example, high density polyethylene or low density polyethylene), polyvinyl chloride, polyamide, an ethylene-vinyl acetate copolymer, and the like, can be used. Among these resins, polyethylene is preferable, because the bonding temperature is low, and it is excellent in adhesiveness.

It is preferable that the adhesive resin has a fiber form or a powder form so that it is excellent in adhesiveness with other materials. More particularly, it has preferably an adhesive resin fiber form, a fiber sheet (for example, a nonwoven fabric or a woven fabric) form containing adhesive resin fibers, or an adhesive resin powder form. Since, if the adhesive resin has a film form, it becomes difficult to stretch during molding, and wrinkles easily occur, it is preferable that the adhesive resin does not have a film form.

The fiber sheet for molding containing the adhesive layer made of adhesive resin fibers can be produced by laminating the adhesive resin fibers on the fiber sheet for molding, and entangling them with a water jet or the like, and/or expressing the adhesiveness of the adhesive resin fibers. The fiber sheet for molding containing the adhesive layer of a fiber sheet containing adhesive resin fibers can be produced by laminating the fiber sheet on the fiber sheet for molding, and entangling them with a water jet or the like, and/or expressing the adhesiveness of the adhesive resin fibers. The fiber sheet for molding containing the adhesive layer of adhesive resin powder can be produced by applying the adhesive resin powder on the fiber sheet for molding, and expressing the adhesiveness of the adhesive resin powder.

When the fiber sheet for molding has the adhesive layer, the amount of the adhesive is not particularly limited, but it is preferably 10 to 60 g/m$^2$, and more preferably 20 to 50 g/m$^2$.

The other materials, which may be adhered to the fiber sheet for molding of the present invention to form a composite, vary depending on the applications of the adhered composite, and are not particularly limited. In the case of automobile applications, which are preferable embodiments, examples thereof include a resin-impregnated glass wool mat, felt, rock wool mat, or resin felt; foams of polyurethane, polystyrene, or polyolefin resin; a nonwoven fabric made of synthetic fibers such as polyester fibers, or the like, in view of rigidity, heat resistance, flame retardance, sound absorbing properties, or the like. Since the fiber sheet for molding of the present invention per se has sound absorbing properties, the other materials are not necessary to be excellent in sound absorbing properties.

The adhered composite can be produced by molding (for example, heat press or cold press) in a state that the adhesive layer of the fiber sheet for molding is brought into contact with the other materials and laminated. Alternatively, it can be produced by molding (for example, heat press or cold press) in a state that the fiber sheet for molding not having the adhesive layer is laminated with the other materials via the above-mentioned adhesive constituent materials (for example, adhesive resin powder, adhesive resin fibers, a fiber sheet containing adhesive resin fibers, or the like).

The adhered composite can be used as, for example, sound absorbing materials in an engine room of automotive, industrial machinery, construction machinery, or the like; sound absorbing materials for buildings, such as apartments, houses, schools, hospitals, libraries, or the like; or automobile ceiling materials or the like, and in particular, it can be suitably used as sound absorbing materials in an engine room of automotive.

EXAMPLES

The present invention will now be further illustrated by, but is by no means limited to, the following Examples.

Examples 1 to 5 and Comparative Examples 1 to 6

A fiber web was formed, using 100% of latent crimpable fibers [fineness: 2.2 dtex, fiber length: 51 mm, manufactured by Toray Industries, Inc., TORAY TETORON (registered trademark) T-25] with a fiber cross-section of a side-by-side type of a combination of polyester/low melting point polyester, by opening the fibers by a carding machine, and then an entangled fiber web was formed by ejecting a water jet having a water pressure of 9 MPa from a nozzle plate (nozzle diameter: 0.13 mm, nozzle pitch: 0.6 mm) onto both surfaces of the fiber web.

Next, the entangled fiber web was dried at 125° C., and was subjected to a heat treatment at 195° C. for about 15 seconds by a hot-air dryer, while being overfed, to express the crimps of the latent crimpable fibers and convert them into highly crimped fibers. Immediately, the heat-treated fiber web were pressed, using calender rolls, under the following conditions as shown in Table 1, in the thickness direction without fusing the highly crimped fibers, to produce compressed nonwoven fabrics (mass per unit area: 140 g/m$^2$) having air permeability as shown in Table 1.

TABLE 1

| | Calendering conditions | | |
|---|---|---|---|
| | Temperature (° C.) | Pressure (kg/cm) | Air permeability (cm$^3$/cm$^2$/sec) |
| Example 1 | 25 | 4.5 | 39 |
| Example 2 | 25 | 5.3 | 29 |
| Example 3 | 25 | 5.3 | 39 |
| Example 4 | 25 | 6.0 | 20 |
| Example 5 | 25 | 5.3 | 39 |
| Comp. Example 1 | 25 | 6.0 | 20 |
| Comp. Example 2 | 25 | 2.5 | 58 |
| Comp. Example 3 | 25 | 1.2 | 82 |
| Comp. Example 4 | 25 | 1.2 | 82 |
| Comp. Example 5 | 25 | 7.5 | 10 |
| Comp. Example 6 | 180 | 300 | 10 |

In parallel, print resin liquids were prepared in the following formulations.

(1) Print Resin Liquid A

Thickener [Carbopol (registered trademark) 940, manufactured by Lubrizol Corporation] . . . 0.24 parts Defoamer [Shin-Etsu Silicone (registered trademark) KM-73, manufactured by Shin-Etsu Chemical Co., Ltd.] . . . 0.7 parts Acrylic resin binder [VONCOAT (registered trademark) AB-886, manufactured by DIC Corporation] . . . 7 parts Black pigment [R.W.BLACK RC(V), manufactured by DIC Corporation] . . . 10 parts Flame retardant [NEOSTECKER (registered trademark) NB-3700, manufactured by NICCA CHEMICAL CO., LTD.] . . . 12 parts
Water repellent [AsahiGuard (registered trademark) AG-E300D, manufactured by ASAHI GLASS CO., LTD.] . . . 1.5 parts
25% Ammonia water . . . 1 part
Water . . . 67.56 parts
(2) Print Resin Liquid B
Thickener [Carbopol (registered trademark) 940, manufactured by Lubrizol Corporation] . . . 0.24 parts
Defoamer [Shin-Etsu Silicone (registered trademark) KM-73, manufactured by Shin-Etsu Chemical Co., Ltd.] . . . 0.9 parts
Acrylic resin binder [VONCOAT (registered trademark) AB-886, manufactured by DIC Corporation] . . . 9.5 parts
Black pigment [R.W.BLACK RC(V), manufactured by DIC Corporation] . . . 13 parts
Flame retardant [NEOSTECKER (registered trademark) NB-3700, manufactured by NICCA CHEMICAL CO., LTD.] . . . 16 parts
Water repellent [AsahiGuard (registered trademark) AG-E300D, manufactured by ASAHI GLASS CO., LTD.] . . . 2 parts
25% Ammonia water . . . 1 part
Water . . . 57.36 parts
(3) Print Resin Liquid C
Thickener [Carbopol (registered trademark) 940, manufactured by Lubrizol Corporation] . . . 0.24 parts
Defoamer [Shin-Etsu Silicone (registered trademark) KM-73, manufactured by Shin-Etsu Chemical Co., Ltd.] . . . 0.55 parts
Acrylic resin binder [VONCOAT (registered trademark) AB-886, manufactured by DIC Corporation] . . . 5.5 parts
Black pigment [R.W.BLACK RC(V), manufactured by DIC Corporation] . . . 7.5 parts
Flame retardant [NEOSTECKER (registered trademark) NB-3700, manufactured by NICCA CHEMICAL CO., LTD.] . . . 8.8 parts
Water repellent [AsahiGuard (registered trademark) AG-E300D, manufactured by ASAHI GLASS CO., LTD.] . . . 1.1 parts
25% Ammonia water . . . 1 part
Water . . . 75.31 parts Next, print resin liquids were wholly printed on one surface of the compressed nonwoven fabrics by planographic printing in combinations as shown in Table 2, and hot-air dried at a temperature of 180° C., to produce nonwoven fabrics for molding, which had the properties as shown in Table 3 and wholly contained print resins.

TABLE 2

| | Printing resin liquid | Number of printing [time(s)] | Amount of print resin ($g/m^2$) |
|---|---|---|---|
| Example 1 | A | 1 | 22 |
| Example 2 | A | 1 | 22 |
| Example 3 | B | 1 | 28 |
| Example 4 | B | 1 | 28 |
| Example 5 | C | 1 | 16 |
| Comp. Example 1 | C | 2 | 33 |
| Comp. Example 2 | B | 1 | 28 |
| Comp. Example 3 | A | 1 | 22 |
| Comp. Example 4 | B | 2 | 60 |

TABLE 2-continued

| | Printing resin liquid | Number of printing [time(s)] | Amount of print resin ($g/m^2$) |
|---|---|---|---|
| Comp. Example 5 | B | 1 | 28 |
| Comp. Example 6 | # | # | # |

#: Not printed

TABLE 3

| | Mass per unit area ($g/m^2$) | Thickness (mm) | Air permeability ($cm^3/cm^2/sec$) | Appearance |
|---|---|---|---|---|
| Example 1 | 162 | 0.68 | 22 | ○ |
| Example 2 | 162 | 0.62 | 15 | ○ |
| Example 3 | 168 | 0.67 | 17 | ○ |
| Example 4 | 168 | 0.54 | 7 | ○ |
| Example 5 | 156 | 0.69 | 28 | ○ |
| Example 6 | 164 | 0.68 | 22 | ○ |
| Comp. Example 1 | 173 | 0.53 | 4 | ▲ |
| Comp. Example 2 | 168 | 0.73 | 33 | ○ |
| Comp. Example 3 | 162 | 0.80 | 62 | ○ |
| Comp. Example 4 | 200 | 0.79 | 30 | ▲ |
| Comp. Example 5 | 168 | 0.46 | 1 | ▲ |
| Comp. Example 6 | 140 | 0.37 | 10 | ▲ |

Example 6

In a similar fashion to that of Example 1, the formation of a fiber web, the formation of an entangled fiber web, the crimp expression of latent crimpable fibers, and the press by calender rolls (temperature: 25° C., pressure: 4.5 kg/cm) were carried out to produce a compressed nonwoven fabric (mass per unit area: 140 $g/m^2$) having an air permeability of 39 $cm^3/cm^2/sec$.

In addition to print resin liquid A, which was the same as that of Example 1, print resin liquid D with the following formulation was prepared.
(1) Print Resin Liquid D
Thickener [Carbopol (registered trademark) 940, manufactured by Lubrizol Corporation] . . . 0.24 parts
Defoamer [Shin-Etsu Silicone (registered trademark) KM-73, manufactured by Shin-Etsu Chemical Co., Ltd.] . . . 0.7 parts
Acrylic resin binder [VONCOAT (registered trademark) AB-886, manufactured by DIC Corporation] . . . 7 parts
Black pigment [R.W.BLACK RC(V), manufactured by DIC Corporation] . . . 5 parts
Flame retardant [NEOSTECKER (registered trademark) NB-3700, manufactured by NICCA CHEMICAL CO., LTD.] . . . 12 parts
Water repellent [AsahiGuard (registered trademark) AG-E300D, manufactured by ASAHI GLASS CO., LTD.] . . . 1.5 parts
25% Ammonia water . . . 1 part
Water . . . 72.56 parts Next, print resin liquid D was wholly printed on one surface of the compressed nonwoven fabric by planographic printing [amount of print resin (solid content): 20 $g/m^2$], and print resin liquid A was printed on the printed surface of print resin liquid D in the arrangement as shown in FIG. 1 (checkered pattern and diagonal line pattern) [amount of print resin (solid content): 4 $g/m^2$]. Hot-air drying was carried out at 180° C. to produce a nonwoven fabric for molding, which wholly had a solid print resin and a pattern print resin with a checkered pattern (mass per unit area: 164 g/m$^2$, thickness: 0.68 mm, air permeability: 22 cm$^3$/cm$^2$/sec). This nonwoven fabric for molding was excellent in design.

(Appearance Evaluation after Molding)

The nonwoven fabrics for molding prepared in Examples 1-6 and Comparative Examples 1-6 were pressed using a pair of molds (maximum depth: 5 cm) at a temperature of 180° C. for 90 seconds to mold them into the shape of an engine room silencer, and produce molded nonwoven fabrics. The appearance of the molded nonwoven fabrics was observed, and evaluated in accordance with the following criteria. The results are shown in Table 3.

(Criteria)

○: Wrinkles were not observed, and the appearance quality was good.

▲: The appearance quality was poor due to the generation of wrinkles.

x: The nonwoven fabric was broken, and the appearance quality was significantly poor.

(Evaluation of Sound Absorbing Properties)

The nonwoven fabrics for molding of Examples 1, 4, 5, and 6 or Comparative Examples 1, 2, and 3 were laminated with a reclaimed fiber felt (mass per unit area: 650 g/m$^2$) containing a phenolic resin using a plate heat press at a temperature of 200° C. to produce molded samples having a thickness of 10 mm.

Next, the sound absorbing coefficient of each molded sample was measured using a normal incident sound absorbing coefficient measuring instrument (manufactured by Brüel & Kjaer) in accordance with a measuring method that conformed to JIS-A1405, and the evaluation was carried out in accordance with the following criteria. The results are shown in Table 4.

(Criteria)

0.20 or higher at 1000 Hz and 0.90 or higher at 4000 Hz; ○ Less than 0.20 at 1000 Hz or less than 0.90 at 4000 Hz; x

TABLE 4

| | Sound absorbing coefficient | | |
|---|---|---|---|
| | 1000 Hz | 4000 Hz | Evaluation |
| Example 1 | 0.22 | 0.97 | ○ |
| Example 4 | 0.27 | 0.91 | ○ |

TABLE 4-continued

| | Sound absorbing coefficient | | |
|---|---|---|---|
| | 1000 Hz | 4000 Hz | Evaluation |
| Example 5 | 0.20 | 0.94 | ○ |
| Example 6 | 0.22 | 0.97 | ○ |
| Comp. Example 1 | 0.30 | 0.77 | x |
| Comp. Example 2 | 0.18 | 0.93 | x |
| Comp. Example 3 | 0.15 | 0.90 | x |

It was found, from the results of Example 4 and Comparative Example 1, that molding could be carried out without generating wrinkles when the amount of the print resin was 30 g/m$^2$ or less and the air permeability was cm$^3$/cm$^2$/sec or more.

Further, it was found, from the results of Example 5 and Comparative Example 2, that the sound absorbing properties were excellent when the air permeability was 30 cm$^3$/cm$^2$/sec or less.

INDUSTRIAL APPLICABILITY

The fiber sheet for molding of the present invention is stretchy during molding, and it can be molded without generating wrinkles, and it is excellent in sound absorbing properties. Therefore, it can be suitably used as a fiber sheet for molding, in particular, of automobile applications, for example, a fiber sheet for the molding of an engine room of an automotive, automotive ceiling materials, or the like.

REFERENCE SIGNS LIST

A: Print resin liquid A

The invention claimed is:

1. A fiber sheet for molding, wherein a print resin is applied and exposed on a surface of the fiber sheet containing highly crimped fibers having a number of crimps of 50 crimps/inch or more, an amount of the print resin is 30 g/m$^2$ or less, an air permeability of the fiber sheet is 5 to 30 cm$^3$/cm$^2$/sec, and a mass per unit area of the fiber sheet is 50 to 200 g/m$^2$.

2. The fiber sheet for molding according to claim 1, wherein the print resin forms a pattern on the fiber sheet.

* * * * *